United States Patent [19]

Slemmons

[11] 4,300,528

[45] Nov. 17, 1981

[54] FIREPLACE DOOR SEAL

[76] Inventor: Charles O. Slemmons, 670 Ardleigh Dr., Akron, Ohio 44303

[21] Appl. No.: 86,474

[22] Filed: Oct. 19, 1979

[51] Int. Cl.[3] ..... F24C 15/10

[52] U.S. Cl. ..... 126/140; 126/202; 49/485; 49/488

[58] Field of Search ..... 126/140, 202, 138; 49/485, 486, 488, 489, 490; 52/716, 717

[56] References Cited

U.S. PATENT DOCUMENTS

| | | | |
|---|---|---|---|
| 2,117,978 | 5/1938 | Oftedal | 49/490 |
| 2,176,555 | 10/1939 | Kuhne et al. | 49/490 |
| 2,264,634 | 12/1941 | Goellner | 49/489 |
| 3,459,173 | 8/1969 | Lydle | 126/202 |
| 4,001,974 | 1/1977 | Wright | 49/490 |

FOREIGN PATENT DOCUMENTS

| | | | |
|---|---|---|---|
| 223274 | 8/1959 | Australia | 49/488 |

*Primary Examiner*—Samuel Scott
*Assistant Examiner*—Lee E. Barrett
*Attorney, Agent, or Firm*—Oldham, Oldham, Hudak & Weber

[57] ABSTRACT

An improvement to the enclosure of fireplace apertures is provided by a sealing strip which engages pivotable glass doors having metallic frames and the frame of the fireplace enclosure. This sealing strip may be a light-weight gauge of brass, bronze, aluminum alloy, steel alloy, or other material capable of withstanding the heat of combustion inside the fireplace but having sufficient spring tension to effect a seal. The strip extends around the entire junction of the glass doors with the fireplace enclosure frame. The sealing strip is insertable into the conjunction of the glass with the glass door frame. Optionally, the strip may extend between moving doors to complete the sealing operation.

6 Claims, 5 Drawing Figures

FIREPLACE DOOR SEAL

BACKGROUND OF THE INVENTION

This invention relates to an improvement to the sealing mechanism for fireplace frame enclosures, utilizing a metallic sealing strip capable of being inserted between the glass and its frame on the glass doors.

In recent years, attention to the conservation of energy has become not only a matter of economic expediency, but also a national and international political concern. The unneeded escape of energy or its inefficient use thereof has plagued the use of conventional fireplaces in residential and rental properties. To meet the need for conservation and efficient use of energy, enclosures of the fireplace aperture have been designed and become readily acceptable in the commercial market place. Examples of fireplace enclosures are U.S. Pat. Nos. 3,459,173 and 3,870,032.

Because the fireplace enclosure is susceptible to intense heat during combustion, all materials used therein must be capable of withstanding that intense heat so generated inside the fireplace. In present designs, the conjunction between the fireplace glass doors and the fireplace enclosure is designed to prevent air leakage. The sealing mechanism must also be unobtrusive to the overall operation of the glass doors in their pivotable characteristics. Therefore, use of elastomeric sealing mechanisms are disruptive to the sliding action of the glass doors when the sealing pieces are placed on the frame on which the doors are mounted.

Metallic sealing mechanisms have been employed in the window enclosure systems for dwellings. U.S. Pat. No. 1,642,176; U.S. Pat. No. 1,751,620; U.S. Pat. No. 1,844,254; U.S. Pat. No. 2,002,569; U.S. Pat. No. 2,015,259; U.S. Pat. No. 2,091,859; U.S. Pat. No. 2,117,978; Norwegian Pat. No. 100,002; British Pat. No. 767,094; and French Pat. No. 940,453 all teach the use of metallic sealing mechanisms for windows or weatherproof systems. Each of these mechanisms requires extensive revision of the fireplace door structure to achieve sealing qualities, such as wider frames reducing glass size. Further, the metallic strips in the present art require fasteners to secure the strips to the glass doors.

Therefore, it is desirable to have a sealing strip which will provide excellent sealing capabilities, and attach economically to existing fireplace enclosures while retaining the ability to withstand the heat of the fire.

SUMMARY OF THE INVENTION

Therefore, it is an object of the invention to provide an improvement to the enclosure for fireplace apertures wherein a sealing strip is provided to engage pivotable glass doors with a metallic frame.

It is another object of the invention to provide improvement to the enclosure of fireplace apertures by use of a sealing strip capable of withstanding the heat of the fire within the fireplace.

Yet another object of the invention is to provide an enclosure to fireplace apertures with a sealing strip which seals areas where air leakage will cause swirling during combustion and loss of heat.

Still a further object of the invention is to provide a sealing strip system which prevents air leakage which provides a means for quickly extinguishing the fire in the fireplace.

Moreover, it is an object of the invention to provide a sealing strip, as above, wherein the installation of the sealing strip requires minimal tooling and minimal expense.

These and other objects of the invention, which will become more apparent as the detailed description of the preferred embodiment proceeds, are achieved by: an improvement to the enclosure of fireplace apertures which use a metallic enclosure frame having an orthogonal recess within which pivotable metal framed glass doors reside, the pivotable nature of the doors having a gap between adjacent framed glass doors, said improvement comprising: a sealing strip engaging the pivotable framed glass doors with the metallic enclosure frame or with adjacent framed glass doors, said strip having a retaining portion insertable between the pivotable glass doors and the metallic enclosure frame or framed glass doors exerting a positive spring tension, and a contact means for sealing said strip across the orthogonal recess or the gap, whereby the pivotable glass doors are sealed within the metallic enclosure frame and between themselves to prevent leakage of air from the interior of a home into the combustion chamber of the fireplace and thence out through the chimney.

DESCRIPTION OF THE DRAWINGS

Reference is made to the drawings for an understanding of the invention, wherein.

DETAILED DESCRIPTION OF THE PREFERRED EMBODIMENTS

Figure 1:
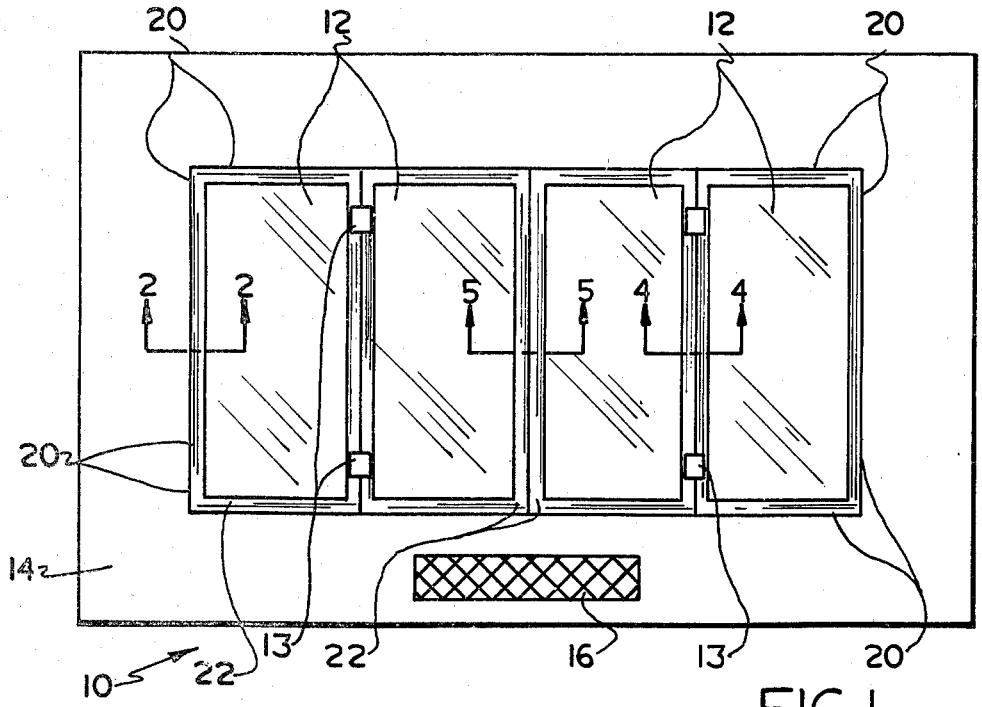
FIG. 1 is a front plan view of the fireplace enclosure.

Reference is made to FIG. 1 for an understanding of the fireplace enclosure 10. This enclosure 10 is mountable against a fireplace and secured by fasteners in a fastening system well known to those skilled in the art. The enclosure 10 is composed of a fireplace enclosure frame 14, and a multiplicity of glass doors 12 enframed by metallic supports. Generally, glass doors 12 reside in pairs which are placed in contiguous relationship by hinging means 13 attached to the metal frames 22. As is well known to those skilled in the art, the fireplace enclosure 10 is designed to control the rate of combustion by introducing oxygen through draft inlet 16 beneath the fire and providing heat through heat transfer to the enclosure 10 while the combustion gases leave the dwelling through the fireplace chimney.

Because it is optimal to provide air at the base of the fire such as through draft inlet 16 which may be regulated (not shown), air leakage through the junction 20 between frames 22 of glass doors 12 and fireplace enclosure frame 14 and between adjacent glass door frames 22 is a serious deficiency to the fireplace enclosures 10 known to those skilled in the art presently. It has been found that the opening about the conventional enclosure is greater than 25 square inches, for an average size residential fireplace equivalent of an uncontrolled exhaust pipe 5.5 inches in diameter. About the periphery of door-frame junction 20, as shown in FIG. 1, the leakage of air during combustion disrupts the draft inlet 16 in its function to provide proper combustion air. It has been found that air leakage through doorframe junction 20 generates a swirl of fresh air mixing with burning gases within the fireplace which smokes the glass and promotes the escape of smoke into the room during the process of opening the doors 12.

During times when the fireplace is not in use, and dampers (not shown) in draft inlet 16 are fully closed, leakage of air through door-frame junction 20 and between adjacent glass door frames 22 is severely responsible for the loss of heat energy within the dwelling to the outside of the building through the fireplace chimney, especially true when the chimney draft cannot be closed until the embers fully expire. This great loss of air from the house interior continues as long as the chimney draft must remain open (for safety reasons) and may not be closed for several days.

This significant air leakage is responsible for the net effect that the fireplace enclosure 10 does not realize the full potential of energy savings over the entire use of the enclosure 10 within the fireplace. As long as there is a path for air to escape from the heated building to the exterior, the heat energy will continue to dissipate from the interior.

The many fireplace enclosures 10 existing in residential use can be improved by retrofitting with a sealing mechanism designed to eliminate this inefficiency of the enclosure 10. Significant energy savings are realized when the sealing mechanism of the present invention is used. This mechanism may be readily adaptable to most styles and designs of the different fireplace enclosures 10. Further, the sealing mechanism is adaptable for those enclosures 10 which are in manufacture, in order that new fireplace enclosures 10 need not be retrofitted to increase the energy savings in actual use.

Figure 2:
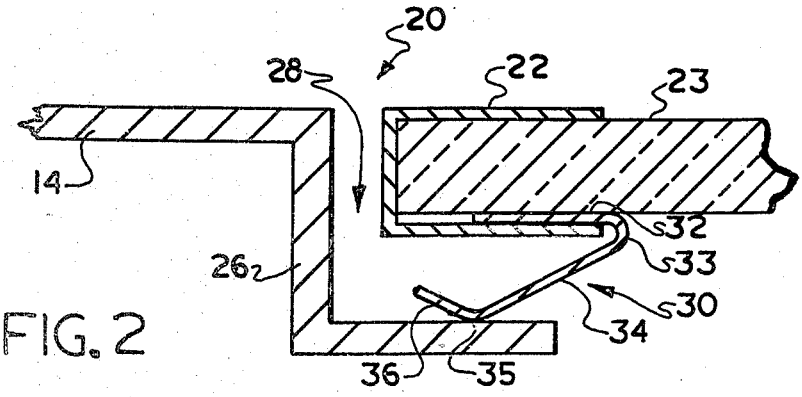
FIG. 2 is a cross sectional view of a segment of the fireplace enclosure taken on lines 2—2 within FIG. 1.
Figure 3:
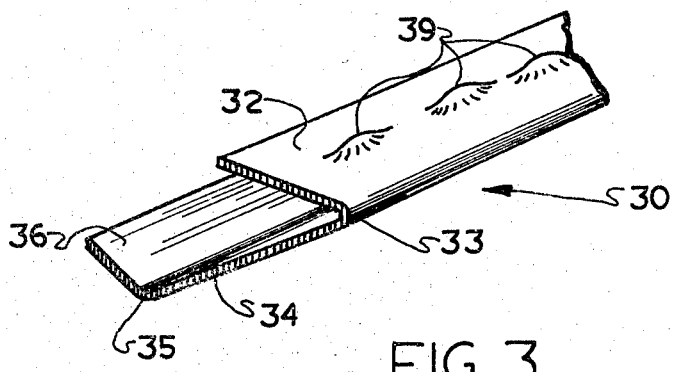
FIG. 3 is a perspective view of the draft sealing strip demonstrating the various functional portions thereof.

Referring now to FIGS. 2 and 3, the scope of the improvement to fireplace enclosure 10 may be seen. About door-frame junction 20, generally referred to in FIG. 2, the fireplace enclosure frame 14 has an enclosure door inset portion 26 which permits the recessed placement of the glass door 12 during use of the enclosure 10. Utilizing hinging means 13 which direct the contiguous contact of each pair of frames 22 of glass doors 12 outward, the door-frame junction 20 must be sufficient to provide movement of the glass door 12 and frame 22 relative to enclosure frame 14. The space for this movement has been generally designated as orthogonal recess 28. The passage of air through orthogonal recess 28 causes the air leakage which is detrimental to the use of fireplace enclosure 10 as described above.

Glass doors 12 are composed of a glass section 23, framed by glass door frame 22. Typically, glass 23 is enveloped by the frame 22. Attachment of sealing mechanisms to the outer portions of glass door frame 22 are susceptible to dislocation or degradation resulting from the repeated movement or the intense heat, respectively. Further, attachments to the fire side of inset 26 near the tracking rails interferes with door movement.

The sealing mechanism of the present invention utilizes the existence of space between glass door frame 22 and glass 23 wherein the draft sealing strip 30 may be inserted. This insertion occurs on the combustion side of frame 22 against which glass 23 resides, and draft sealing strip 30 then proceeds to seal the remaining space of orthogonal recess 28 during use of the fireplace during combustion, or when the doors are closed and the fireplace is not in use. Indeed the shape of draft sealing strip 30 is designed to flex in response to the differential air pressure of the fireplace combustion chamber and the interior, such that the sealing strip 30 tends to remain in a sealed position. FIG. 2 demonstrates the flex of strip 30 to maintain a seal across recess 28 when air leakage attempts to follow the path of arrow 28.

FIG. 3 indicates that the shape of the draft sealing strip 30 is composed of three portions of uniform thickness, retaining portion 32, spring portion 34, and contact portion 36. The various portions are produced from bending a single strip 30. This retaining portion 32 must be of limited thickness in order that it may be insertable between glass 23 and glass door frame 22 adjacent to orthogonal recess 28. Typically, sheet metal of approximately 0.005 inch is insertable between glass 23 and frame 22. The retaining portion 32 may be restrained between glass 23 and frame 22 by a frictional contact of pressured insertion, a system of intermittent or continuous corrugations 39 seen in FIG. 3, or any adhesive bonding agent known to those skilled in the art. Typically, restraining portion 32 is $\frac{3}{8}$ inch long.

Spring portion 34 of draft sealing strip 30 must be of sufficient thickness and length to provide a tensionable extension of strip 30 between retaining portion 32 and enclosure door inset 26 of frame 14. To insure adequate contact with inset 26, contact portion 36 is necessary to provide a continuous and uniform contact along the interior surface of inset 26 of frame 14. Contact portion 36 further serves to guide strip 30 into place when doors 12 are pivoting into their closed position.

A light but positive spring tension is necessary to accommodate the low holding force of the usual detent that is used to secure a door in its closed position. Therefore, to sufficiently seal orthogonal recess 28, spring portion 34 should be bent at an angle 33 from about 25° to 35° and preferably 30° with respect to restraining portion 32. Likewise, contact portion 36 should be bent at an angle from 90° to 120° and preferably 90° with respect to spring portion 34. Both portions 34 and 36 should be of sufficient length to permit tensional contact across recess 28. Typically, portion 34 is $\frac{3}{8}$ inch and portion 36 is $\frac{1}{8}$ inch for conventional enclosures 10.

Sealing strip 30 may be composed of a lightweight gauge of brass, bronze, aluminum alloy, steel alloy, or other material that will withstand the intense heat yet provide a sufficient spring loaded tension to effect a seal when the glass door frame 22 is closed against frame 14 at door-frame junction 20. Junction 20 exists about the entire rectangular area, as shown in FIG. 1, and draft sealant strip 30 may be mitred at the corners thereof to continue the sealing function in the various corners of junction 20.

A key feature of the invention is the insertability of the sealing strip 30 between glass door frame 23 and glass 22. This insertability of draft sealing strip 30 permits the retrofitting of existing fireplace enclosures 10 currently in use, and further provides ease of manufacture on original equipment fireplace enclosures 10.

Because the various plurality of glass doors 12 may differ for different fireplace enclosures 10 and the designs of fireplace enclosures 10 themselves may differ, draft sealing strip 30 is capable of being used, as long as it is insertable between frame 22 and glass 23. This removes the cost of expensive tooling or expensive assemblage both in the retrofit and the current manufacturing functions. Draft sealing strip 30 further may be installed with minimal expense in the home by the homeowner having little tooling or expertise to accomplish a conventional retrofitting operation.

It has been found that the use of a draft sealing strip 30 of this design, insertable between frame 22 and glass 23 has proved significantly capable of enclosing door-frame junction 20 at orthogonal recess 28. In a test conducted where all dampers on draft inlet 16 were closed, the glass doors 12 were closed into fireplace enclosure frame 14, significant sealing properties were found. Because inlet 16, and all other apertures were taped shut, a comparison could be obtained between the fireplace enclosure 10 having draft sealing strip 30 and a fireplace enclosure 10 having the minimal sealing capacity provided by manufacturers. The fireplace enclosure 10 having draft sealing strip 30 about door-frame junction 20 reduced the air flow approximately 80% from that found when fireplace enclosure 10 had the conventional attempts at sealing junction 20. It has been found that use of sealing strips 30 can eliminate 96% of air leakage gaps around doors 12 in conventional fireplace enclosures, reducing the air leakage around the periphery of junction 20 to approximately one square inch in the average conventional enclosure.

Figure 4:
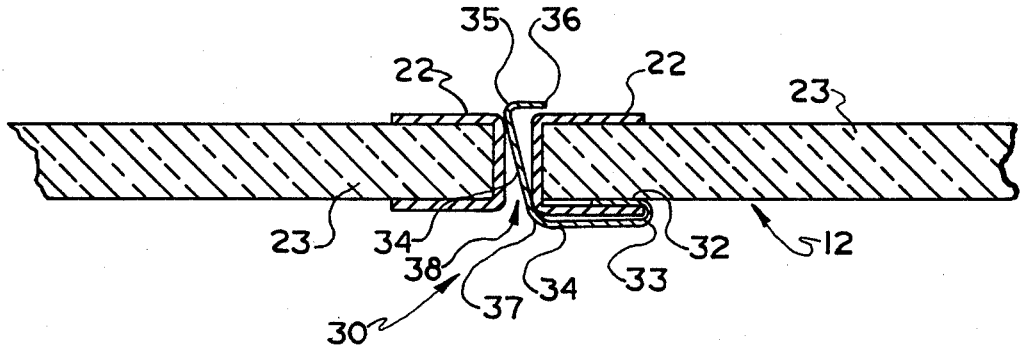
FIG. 4 is a cross sectional view of a segment of the fireplace enclosure taken on lines 4—4 within FIG. 1.

Sealing strip 30 may be optionally modified to provide sealing properties between adjacent frames 22 of doors 12. While the length and angle of portions 34 and 36 have been modified, these portions accomplish the same purposes for adjacent frame 22 instead of inlet 26 and recess 28. In FIG. 4, it may be seen that sealing strip 30 has retaining portion extending between glass 23 and frame 22 which is abruptly and severely bent back to form an extended tension portion 34. The hairpin angle between retaining portion 32 and tension portion 34 is between 0° to 10° preferably.

Tension portion 34 is extended in length to compensate for the distance to contact frame 22 of adjacent door 12. Further tension portion 34 is bent in its relative midsection to pass between adjacent frames 22 in an area denominated gap 38. This midsection angle is from about 110° to about 130°, which provides tension by compression when adjacent door 12 is fully closed in gap 38 and the angle 37 is reduced to from about 90° to about 100°.

Contact portion 36 engages the surface of frame 22 of adjacent door 12 as tension portion 34 is compressed. This contact under tension seals the gap 38 between the two doors 12. As elsewhere, the angle between portion 34 and portion 36 is approximately 90° to 120° and portion 36 extends approximately ⅛ inch to maintain the position of sealing strip 30 within gap 38 when the adjacent door 12 is open.

Figure 5:
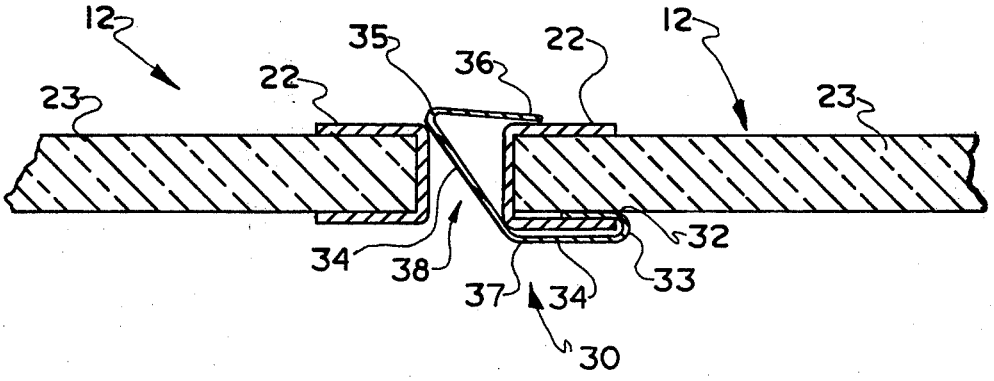
FIG. 5 is a cross sectional view of a segment of the fireplace enclosure taken on lines 5—5 within FIG. 1.

FIG. 5 demonstrates the modifications to sealing strip 30 necessary when gap 38 is larger, such as where doors 12 unconnected by hinging means 13 come together. Should gap 38 be larger where two doors 12 meet, the length of tension portion 34 increases and midsection angle 37 increases to about 130° to 150° when uncompressed and from about 100° to about 120° when compressed. Likewise, the angle 33 between restraining portion 32 and tension portion 34 is increased to about 10° to 30°. Further, the length of contact portion 36 is increased to maintain the position of sealing strip 30 over frame 22 of door 12. Finally, the angle 35 between portions 34 and 36 is reduced to about 50°–80° to conform to the modification of length requirements. All of the modifications expressed with reference to FIGS. 4 and 5 are available for the door-frame junction 20 if it is desired to provide the sealing mechanism in the area of recess 28 orthogonal to the area sealed in FIG. 2. Therefore, the present shape of inlet 26 reduces the lengths and angle tolerances, but all modifications remain within the scope of the present invention. Further, the phrase metallic framing structure generally refers to either the metallic enclosure frame 14 or the metal frame 22 of glass doors 12, because the objects of the invention are accomplished without regard to the type of structure against which sealing strip 30 contacts at portion 36.

While in accordance with the patent statutes, a preferred embodiment of the invention has been disclosed, the invention is not to be limited thereto or thereby. Therefore, for an understanding of the scope of the invention, reference is made to the following claims.

What is claimed is:

1. An improvement to the enclosure of fireplace apertures which use a metallic enclosure frame having an orthogonal recess within which pivotal metal framed glass doors reside, the pivotable nature of the doors having a gap between adjacent framed glass doors, said improvement comprising:

a one piece metallic sealing strip engaging the pivotable framed glass doors with the metallic enclosure frame or with adjacent framed glass doors, said strip being bent along its length into three portions including an outside retaining portion inserted and held in cooperative frictional retention between the glass and the metal frame, a middle spring portion extendable between the pivotable glass doors and the metallic enclosure frame or framed glass doors exerting a positive spring tension, and an outside contact portion for sealing said strip across the orthogonal recess or the gap, whereby the pivotable glass doors are sealed within the metallic enclosure frame and between themselves to prevent leakage of air from the interior of a home into the combustion chamber of the fireplace and thence to the chimney.

2. An improvement according to claim 1, wherein said sealing strip is of uniform width and each portion is of uniform width along the full length of the strip.

3. An improvement according to claim 2, wherein said retaining portion has a plurality of intermittent or continuous corrugations.

4. An improvement according to claim 3, wherein said retaining portion intersects said tensional portion at an angle from about 25° to about 35°.

5. An improvement according to claim 4, wherein said tension portion intersects said contact portion at an angle from about 90° to about 120°.

6. An improvement according to claim 1, wherein said tension portion is wider than the other two portions and bent at a midsection angle of from about 90° to about 100° when compressed by contact with the adjacent framed glass door.

* * * * *